US006513562B1

(12) United States Patent
Trout

(10) Patent No.: US 6,513,562 B1
(45) Date of Patent: Feb. 4, 2003

(54) DRYWALL TAPING TOOL

(76) Inventor: Willis Z. Trout, 1124 Siddonsburg Rd., Mechanicsburg, PA (US) 17055

( * ) Notice: Subject to any disclaimer, the term of this patent is extended or adjusted under 35 U.S.C. 154(b) by 87 days.

(21) Appl. No.: 09/689,240

(22) Filed: Oct. 12, 2000

(51) Int. Cl.[7] ..... B32B 31/00

(52) U.S. Cl. ..... 156/391; 156/538; 156/526; 156/575; 156/577; 156/578; 118/40; 118/419

(58) Field of Search ..... 118/40, 209, 108, 118/419; 156/350, 356, 358, 538, 540, 545, 526, 575, 577, 579, 521, 574, 578, 524, 510, 391, 525, 518; 401/48, 101, 109, 119, 126, 136, 140, 170, 171, 176, 182; 239/95, 103, 319, 320, 568

(56) References Cited

U.S. PATENT DOCUMENTS

| | | | | |
|---|---|---|---|---|
| 2,815,142 A | | 12/1957 | Ames | 216/25 |
| 3,260,638 A | * | 7/1966 | Hoveland | 156/461 |
| 4,086,121 A | | 4/1978 | Ames | 156/526 |
| 4,652,331 A | * | 3/1987 | Plasencia | 156/526 |
| 4,828,647 A | | 5/1989 | Eccleston | 156/526 |

OTHER PUBLICATIONS

Catalog—Premier Drywall Tool Co.—The New Generation of Drywall Taping Tools.

Catalog—TapeTech—Why should you be using a TapeTech Automatic Taper and Drywall Finishing System?.

Catalog—Ames—Tools, Supplies, Service.

Catalog—Murco Wall Products.

* cited by examiner

*Primary Examiner*—Richard Crispino
*Assistant Examiner*—Sing P. Chan
(74) *Attorney, Agent, or Firm*—Barley Snyder

(57) ABSTRACT

This invention provides a unitary nozzle for use in a taping apparatus. The unitary nozzle features a cradle section adjacent a tube receiving section and a flange for sealingly receiving a mastic tube. A mastic is extruded and contained along a path extending along one side of the tape and between a front and rear end of the nozzle.

36 Claims, 3 Drawing Sheets

DRYWALL TAPING TOOL

FIELD OF THE INVENTION

This invention is related to an apparatus for applying tape to joints between sections of pre-fabricated wall board.

BACKGROUND

Self-contained drywall taping apparatus are well known in the industry. These apparatus typically contain a long hollow tube which is filled with mastic utilizing a pump fed from a mastic supply. On the end of the hollow tube, a nozzle is attached. The nozzle serves to both feed tape and apply mastic to the tape and wall joint.

Several examples of drywall taping apparatus are taught by Ames in U.S. Pat. Nos. 4,086,121 and 2,815,142 and by Eccleston in U.S. Pat. No. 4,828,647. As best shown in U.S. Pat. No. 4,828,647, the Eccleston apparatus comprises a tubular body 14 which serves as a handle or grip and holds a quantity of mastic. The interior of the body 14 is provided with a piston and means for actuating the piston to extruded mastic. An outlet positioned adjacent a feeding path is provided for extruding the mastic onto the tape. Drive wheels 17 are mounted on a shaft and serve as the motive force for the apparatus as it is moved along the wall. A sprocket 27 rotates with the wheels 17 to operate a piston inside the main body 14 for extruding the mastic.

The nozzles of these taping apparatus are typically formed of metallic components which are precisely machined and fastened together with screws. The components are typically formed of stainless steel or aluminum and are precisely machined to receive the screws into threaded openings. The many components are best shown in FIG. 1. This prior art nozzle 1 consists of a filler tube inlet 2 which is screwed to a pair of side walls 3,4 with screws 5 in threaded openings 6. A stabilizer 7 secures the taping guide track 8 to the side walls 4 with screws 5 in threaded openings 6. Bearing surfaces 9 are also screwed into the side walls 4. Tape guides 10 are screwed into the side walls 4. Other stabilizing bars are also screwed into the side walls and extend therebetween under the plate 11. A pair of cutter mechanism retention members 12 are also screwed into the side walls 4. It can be appreciated by those reasonably skilled in the art that the fabrication technique of this nozzle 1 is to secure a multitude of metallic components between a pair of side walls 4. At locations where each of these components meets the side walls 4, there is the potential for leakage of the mastic material. Such leakage is undesirable. This potential for leakage is increased due to the cumulative tolerances of each of the individual components. Although each individual component is precisely machined, the individual components are manufactured within defined tolerance limits. When numerous individual components are secured together, the individual tolerances add together, thereby causing particular components to have a space provided therebetween, magnifying the leakage problem.

An attempt to address the leakage problem includes the application of the silicone sealant to the areas where the mastic tends to escape the nozzle. While the sealant can provide a short term solution to the leakage of material, the sealant can degrade over time and usage. The addition of the sealant also requires additional steps in the assembly and maintenance of the nozzle and adds to the cost thereof.

Because this nozzle is formed of multiple metallic components requiring precision machinery for assembly the cost of manufacturing such a nozzle is high. In addition, field adjustments to the components are required for optimum operation of the nozzle. These adjustments are necessary in order to allow the numerous parts to be tweaked in order to minimize the leakage discussed above. The adjustments also allow the operator to achieve the appropriate dispersion of mastic or mud onto the tape during application. The field adjustment of the components may prove difficult, as the number of components and screws make it difficult to maximize the effectiveness of the tool. It is therefore, very time consuming to adjust the tool in the field. The difficulty of field adjustment is also increased because the operator has to have the appropriate adjustment tools available. Having the appropriate adjusting tools readily available in the field is not always practical.

It would therefore be advantageous to provide a nozzle which minimizes the number of individual components. This would greatly reduce the time required to assemble the nozzle and the cumulative tolerances and field adjustments would be minimized. With the reduction of individual components, the possibility of leakage occurring in the nozzle would also be reduced or eliminated.

SUMMARY

This invention addresses the problems with the state-of-the-art nozzles because it provides a substantially unitary design. The unitary nozzle includes a tape receiving opening that extends into a tape path through a fill section to a front end. The unitary design allows for the application of a cutter mechanism, wheels to provide motive force and a mastic tube to supply mastic to the fill section.

This unitary design prevents leakage of mastic material into undesired sections of the nozzle and out of the nozzle. The unitary design also eliminates the need for precision machining and field adjustments because the components are precisely molded or formed into a unitary design during manufacturing. As the nozzle is made from one piece, precision machining of each individual piece to minimize tolerance problems is eliminated and the need for many of the field adjustment members is also eliminated. Service on the nozzle is also reduced in that the application of a sealant is eliminated and adjustments are minimized.

BRIEF DESCRIPTION OF THE DRAWINGS

The invention will now be described by way of example with reference to the accompanying figures of which.

DETAILED DESCRIPTION OF THE PREFERRED EMBODIMENT

Figure 4:
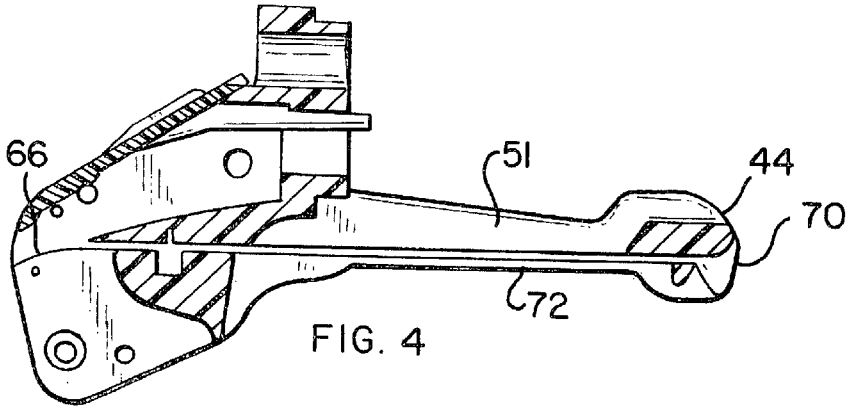
FIG. 4 is a cross-sectional view of the nozzle shown in FIG. 2.
Figure 5:
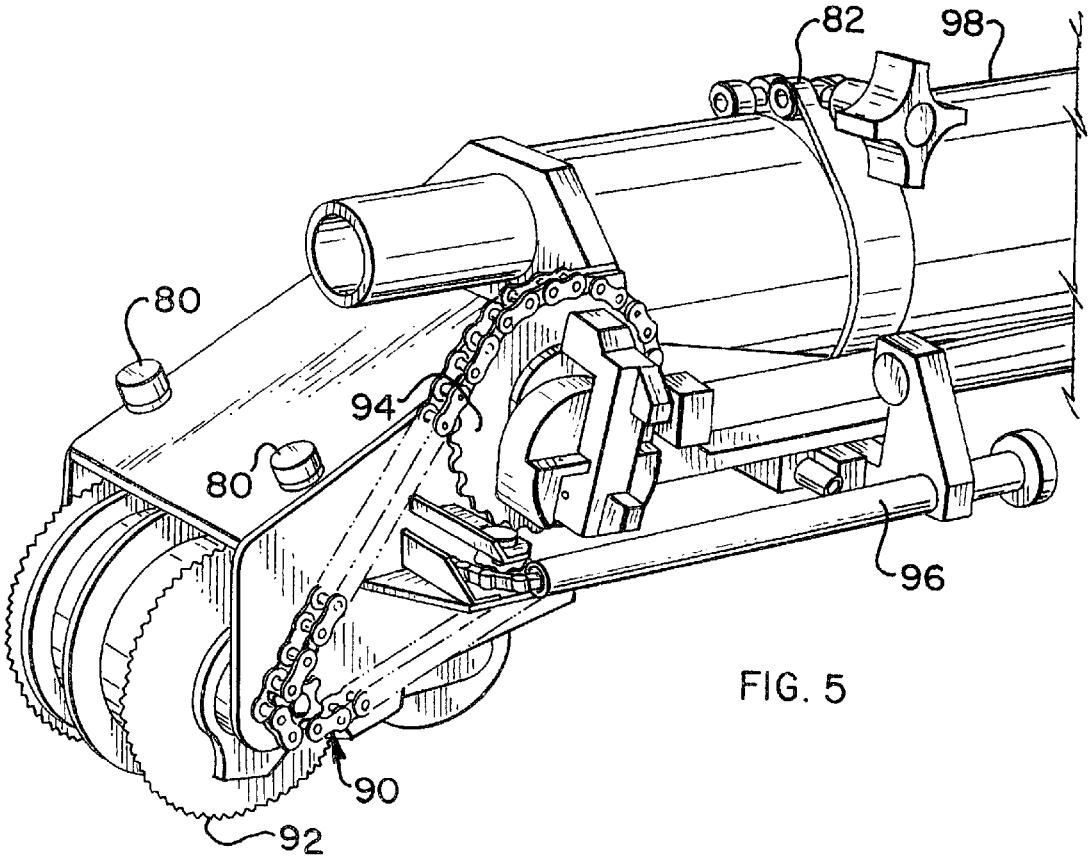
FIG. 5 is a three-dimensional view of the nozzle of FIG. 2 assembled to a mastic tube of a taping apparatus.

The invention will now be described in greater detail with reference to FIGS. 1–5. First, the invention will be described generally with reference to FIG. 2. The nozzle 20 with consists of only two major components. A cover 30 is provided over the main body 40. The main body 40 is of a unitary design and may be formed of a suitable molded, cast or machined material. The main body 40 is designed to fit over and cooperate with state-of-the-art drywall taper mastic tubes as shown in FIG. 5.

Figure 1:
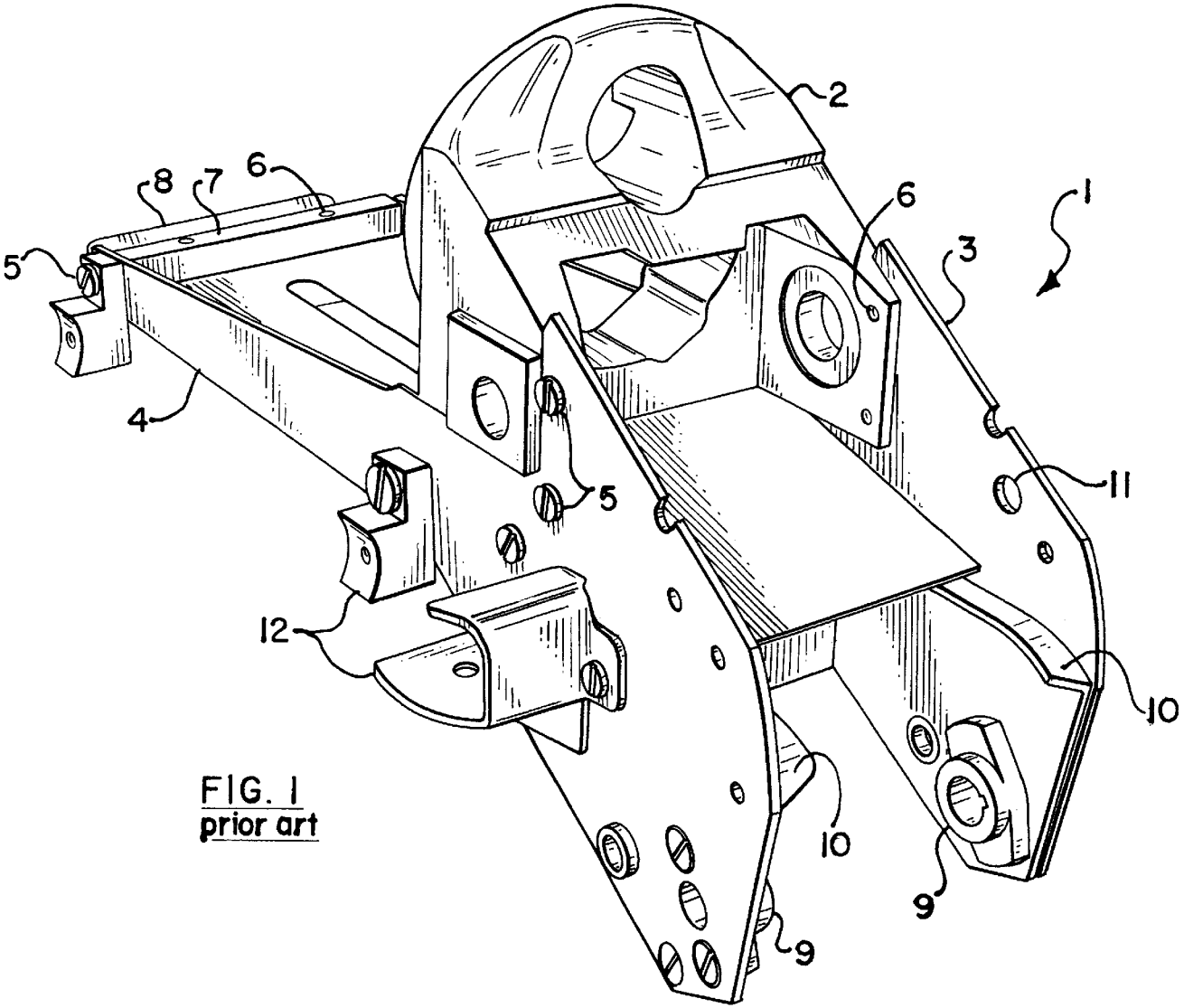
FIG. 1 prior art
FIG. 1 is a three-dimensional view of a prior art nozzle.
Figure 2:
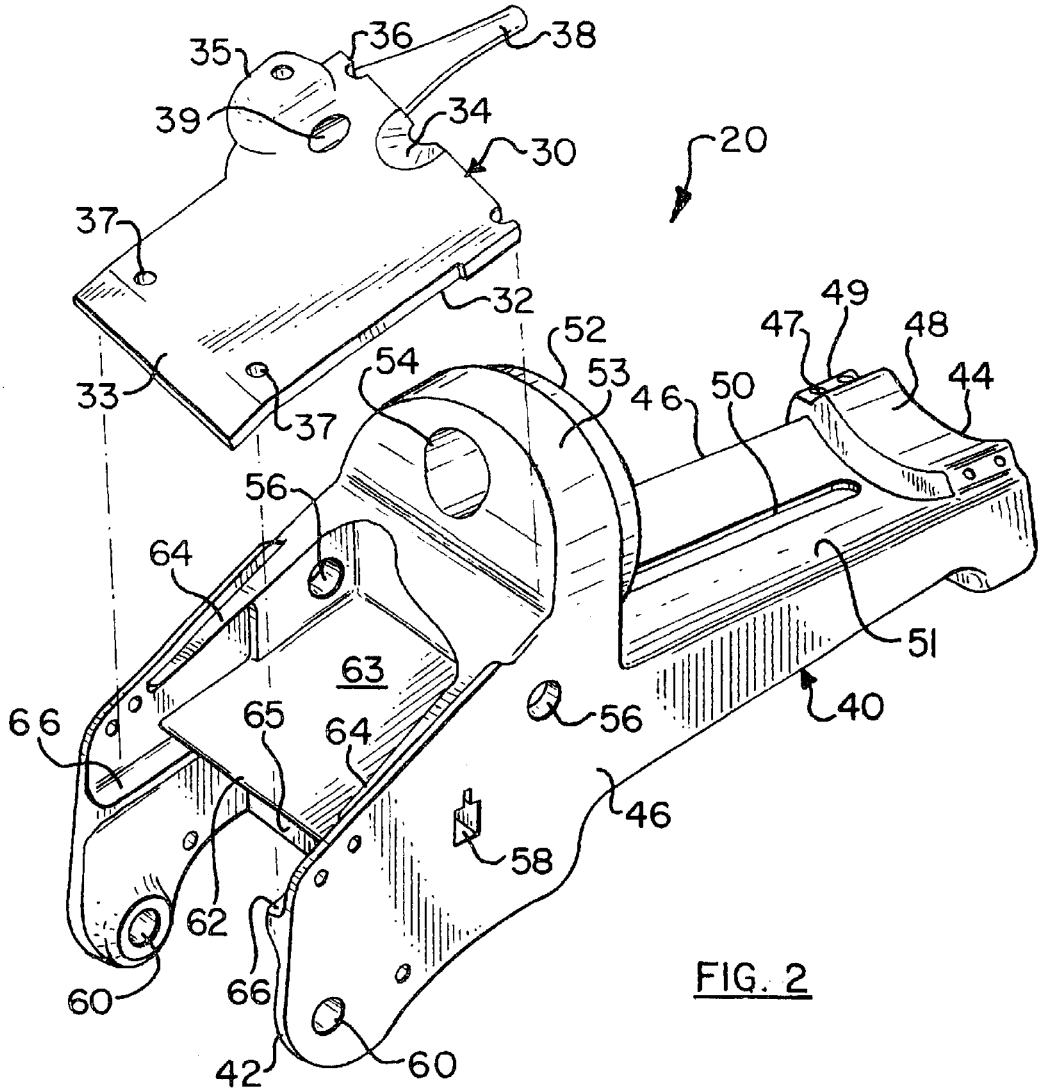
FIG. 2 is a three-dimensional top view of the nozzle according to the present invention.

Each of the major components will now be described in greater detail with reference first to FIG. 2. The main body 40 is formed of a unitary construction having a front end 42 and a rear end 44 joined by a pair of side walls 46. Beginning at the rear end 44, a cradle section 48 extends between the side walls 46 in a semicircular profile. A ledge 49 is provided adjacent to the cradle section 48. A pair of securing holes 47 extend into the ledge 49. A tube supporting section 51 is positioned between the side walls 46 adjacent to the cradle section 48 and a slot 50 is provided in the tube supporting section 51. A tube receiving section 53 is positioned between the side walls 46 and adjacent to the tube supporting section 51. A circular flange 52 extends from the tube receiving section 53 toward the tube supporting section 51. Suitable fasteners may be provided along the flange 52 for receiving a mastic tube. A fill opening 54 extends through the tube receiving section 53 from the tube supporting section 51 toward the front end 42. A pair of axle receiving openings 56 are formed in the side walls 46 near the tube receiving section 53. A pair of cutter openings 58 are also formed in the side walls 46. The cutter openings 58 are in communication with a tape path which will be described below. Cover receiving ledges 64 extend inward from each side wall 46. Wall 62 also extends between the side walls 46 and is located above the cutter openings 58. A fill section 63 is defined by the side walls 46 and the wall 62. Tape guide surfaces 66 extend into the fill section 63 toward each other from each side wall 46 at the front end 42. A second wall 65 also extends between the side walls 46 below the fill section 63. Both the wall 62 and the second wall 65 serve as integral strength members adding rigidity to the main body 40. A pair of wheel axle openings 60 extend through each side wall 46 proximate the front end 42.

Figure 3:
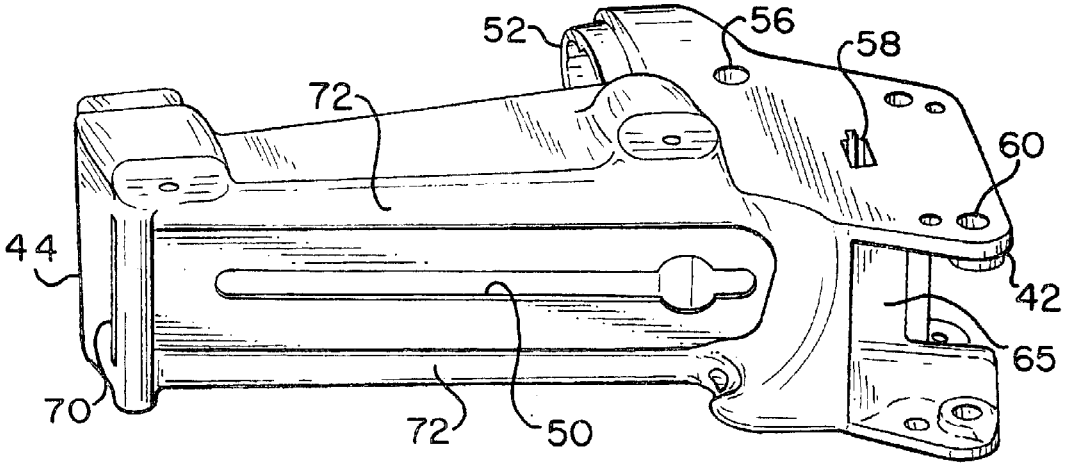
FIG. 3 is a three-dimensional bottom view of the nozzle shown in FIG. 2.

Referring now to FIG. 3, it can be seen that the slot 50 extends from the rear end 44 toward the front end 42. Tape guide rails 72 extend along the length of the tube supporting section 51 on the underside of the main body 40. These rails 72 are spaced from the slot 50 and the bottom surface of the tube receiving section 51. A tape receiving opening 70 is provided along the rear end 44.

The cover 30 is of the unitary construction having an inside surface 32 adjacent the fill section 63 and a taper 33 near the front end 42 of the nozzle 20. A pair of securing openings 37 extend from the inside surface 32 through the cover 30. A curved cut out 34 is formed in a rear end 36. A push rod receiving member 38 and a shelf 35 are also provided on the cover. The push rod receiving member 38 has a conical configuration and is dimensioned to allow a push rod to extend from the fill section 63 through the cover 30. The shelf 35 is dimensioned to receive a pivot member thereon, the pivot member being moved by the push rod as the fill section 63 becomes empty. In assembly, the cover 30 is placed onto the main body 40 and received in cover receiving ledges 64. A pair of suitable fasteners 80 (FIG. 5) are utilized to secure the cover 30 to the main body 40. The cooperation of the cover 30 with the cover receiving ledges 64 and the use of fasteners 80 provides a tight seal in which the mastic will be maintained within the fill section 63.

As best shown in FIG. 5, the nozzle 20 is completed by adding wheels 92 on suitable axles secured in openings 60, sprocket and chain assembly 90, 94, a cutter assembly 96, and a mastic tube 98 secured by securing means 82. These components are known in the art and the nozzle 20 is designed to be optionally interchangeable with prior art nozzles so that each of these components are similarly received by the nozzle 20. A mastic tube is sealingly secured to the nozzle 20.

Operation of the nozzle 20 will be described in greater detail with reference to FIG. 4. Tape is inserted into the tape receiving openings 70 from the end 44. The tape is then fed along a tape path extending from the rear end 44 along the tape guides rails 72 beneath the slot 50, through the fill section 63 and finally passed tape guide rails 66 at the front end 42. A mastic is applied to the tape in the fill section 63 near the front end 42 and is extruded utilizing motive force beginning at the wheels 92 and transferred through the chain 90 and sprocket 94 to a piston in the mastic tube 98 as its well known in the art. Extrusion occurs without mastic passing into unwanted areas due to the unitary sealed design of the nozzle 20.

The application of the mastic to the tape must be accurately controlled. If the mastic is improperly applied to the tape, the tape will not properly adhere to the wall. Also, if the mastic is not properly confined in the appropriate areas of the nozzle, the mastic will interfere with the operation of the nozzle, thereby causing the operator to spend more time maintaining the tool. The nozzle of the present invention is advantageous because the nozzle more accurately controls the mastic. Due to the unitary configuration of the nozzle, there are less gaps between individual components, thereby reducing the number of places where the mastic can leak.

Also, as many individual components are replaced by the unitary nozzle, many individual parts are eliminated. The reduction in the number of parts eliminates the need for precise machined parts which in turn greatly reduces corresponding problems associated with cumulative tolerances. This significantly reduces the cost of manufacture of the nozzle, as the is individual components do not have to be manually assembled. In fact, the present invention can reduce the time to assemble the nozzle by four times or more.

The unitary design also provides advantages in the field. As individual components are eliminated, the need to "tweek" the nozzle in the field is minimized. As individual components are eliminated, the movement between the components is also eliminated. As movement of components relative to each other can significantly increase leakage, the unitary design of the present invention substantially reduces the need to tweek the nozzle in the field.

The strength and integrity of the unitary design is also helpful. When operating a tool in the field, conditions can be less than ideal. During use, tools can be dropped or banged against a wall. With the unitary design, the nozzle stays intact and individual components are not moved relative to each other. With the prior art design, the individual components of the nozzle could be skewed relative to each other, causing the operation of the nozzle to become more difficult. This would ultimately result in the operator being required to make field adjustments or return the nozzle to the shop for repairs. This is eliminated by the design of the present invention.

It is also worth noting that the unitary design eliminates the need for various skews and adjustment members, which eliminates weight from the nozzle. As the nozzle is positioned away from the operator's hands, any reduction in weight greatly adds to the comfort of the operator. The use of lightweight material to mold the nozzle also reduces the overall weight of the tool. The elimination of the various adjustment members also eliminates the need for specialty adjustment tools which must be used to manipulate the adjustment members.

The molding of the unitary nozzle also eliminates sharp, well-defined corners from the nozzle. As the nozzle is one piece, the intersection of walls can be molded with gradual radiuses. This type of surface is easier to clean, as the mastic will not gather in the comers. Also, the elimination of precise machined metal components eliminates the possibility that rust will cause harm to the nozzle.

The nozzle may be molded in one piece, as described above, or it may be molded in component form. The components would be joined together using tongue and groove technology or other known methods of connection in which the securing members are integrally molded with the components and the securing members cooperate to interlock the components together. The nozzle could also be molded in component form and glued together. Manufacturing the nozzle in component form can reduce the complexity of the mold required to manufacture the product. However, by securing the components together, the nozzle essentially acts as a unitary structure, eliminating the need for field adjustments. As the components are secured to each other and will not move inadvertently, the use of hardware to allow for the components to be adjusted is not required. The other advantages described for the unitary design are also applicable to this embodiment.

The foregoing illustrates just some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A nozzle having a unitary main body for use in a taping apparatus comprising:

a fill section extending between a pair of side walls and in communication with a mastic tube;

a tube receiving flange adjacent the fill section; and, pair of tape guide rails extending along the fill section to an end wherein the sections and rails are formed of a unitary construction to sealingly receive the mastic tube.

2. The nozzle of claim 1 further comprising a cover positioned over the fill section near the tube receiving flange on the main body.

3. The nozzle of claim 2 further comprising a tape path extending from an opening in a rear end past the fill section and through the tape guide rails.

4. The nozzle of claim 1 wherein the main body further comprises an opening for receiving a cutter.

5. The nozzle of claim 1 wherein the main body further comprises an opening for receiving a sproket axle.

6. The nozzle of claim 1 wherein the main body further comprises an opening for receiving a wheel axle.

7. The nozzle of claim 1 wherein mastic is contained in a path defined by one side of a tape and a fill section having a first opening adjacent the mastic tube and a second opening adjacent the tape.

8. The nozzle of claim 1 wherein the main body is formed of a molded material.

9. The nozzle of claim 1 wherein the main body is formed of a cast material.

10. The nozzle of claim 1 wherein the main body is formed of a machined material.

11. The nozzle of claim 1 wherein the main body is plastic.

12. A nozzle for applying mastic to a tape comprising:

a unitary main body having a tape path extending along tape guide rails unitary with the main body, a fill section in the tape path and extrusion means for supplying mastic to the fill section; and, a cover positioned on the main body over the fill section to contain flow of the mastic onto the tape.

13. The nozzle of claim 12 wherein the main body further comprises a cover receiving ledge extending into the fill section for sealingly engaging the cover.

14. The nozzle of claim 12 further comprising a tape receiving opening in a rear end.

15. The nozzle of claim 12 wherein the main body further comprises an opening for receiving a cutter.

16. The nozzle of claim 12 wherein the main body further comprises an opening for receiving a sprocket axle.

17. The nozzle of claim 12 wherein the main body further comprises an opening for receiving a wheel axle.

18. The nozzle of claim 12 further comprising a lateral wall unitary with the side walls and extending between the side walls on one side of the fill section.

19. The nozzle of claim 18 further comprising rounded transitions between the wall and the side wall.

20. The nozzle of claim 12 wherein the main body is formed of a molded material.

21. The nozzle of claim 12 wherein the main body is formed of a cast material.

22. The nozzle of claim 12 wherein the main body is formed of a machined material.

23. The nozzle of claim 12 wherein the main body is plastic.

24. A nozzle for applying mastic to a tape comprising:

a unitary main body having a fill section being partially formed of a pair of side walls, a lateral wall extending between the side walls, and transition sections having a radius extending between the lateral and side walls.

25. The nozzle of claim 24 further comprising a cover receiving ledge extending from one of the side walls into the fill section.

26. The nozzle of claim 25 further comprising a cover positioned on the cover receiving ledge over the fill section.

27. The nozzle of claim 24 further comprising a tape path extending from an opening in a rear end past the fill section and through tape guide rails.

28. The nozzle of claim 24 wherein the main body further comprises a side wall opening for receiving a cutter.

29. The nozzle of claim 24 wherein the main body further comprises a side wall opening for receiving a sprocket axle.

30. The nozzle of claim 24 wherein the main body further comprises a side wall opening for receiving a wheel axle.

31. The nozzle of claim 24 wherein the main body is formed of a molded material.

32. The nozzle of claim 24 wherein the main body is formed of a cast material.

33. The nozzle of claim 24 wherein the main body is formed of a machined material.

34. The nozzle of claim 24 wherein the main body is plastic.

35. A nozzle for applying tape and mastic to a surface, the nozzle comprising:

a molded body having a plurality of molded components which are joined together to form the body;

securing members integral with the components, the securing member of one component cooperate with the securing member of another component to maintain the respective components in position relative to each other;

whereby as the nozzle is subjected to external forces during use, the components are not moved relative to each other.

36. The nozzle of 35 wherein the molded components are plastic.

* * * * *